United States Patent [19]

Pomilia

[11] Patent Number: 4,682,773

[45] Date of Patent: Jul. 28, 1987

[54] BASEBALL TRAINING BAT

[76] Inventor: Gino Pomilia, 111 Palm Ave., Corte Madera, Calif. 94925

[21] Appl. No.: 737,907

[22] Filed: May 28, 1985

Related U.S. Application Data

[63] Continuation of Ser. No. 554,027, Jan. 23, 1984, abandoned, which is a continuation of Ser. No. 323,726, Nov. 23, 1981, abandoned, and Ser. No. 121,999, Feb. 19, 1980, abandoned.

[51] Int. Cl.[4] ..... A63B 69/40

[52] U.S. Cl. ..... 273/26 B; 273/67 R; 273/72 A; 273/DIG. 8

[58] Field of Search ..... 273/26 B, 72 R, 67 R, 273/84 R, 193 R, 77 A, 80 R, 80 B, DIG. 8

[56] References Cited

U.S. PATENT DOCUMENTS 1,994,069 3/1935 Fletcher ..... 273/67 R 3,972,528 8/1976 McCracken ..... 273/72 A

FOREIGN PATENT DOCUMENTS 47910 10/1979 Japan ..... 273/80 R 97305 11/1960 Norway ..... 273/72

*Primary Examiner*—Richard C. Pinkham

*Assistant Examiner*—T. Brown

*Attorney, Agent, or Firm*—Michael, Best & Friedrich

[57] ABSTRACT

A bat has a generally uniform outside diameter from its handle through its extension from the handle through to its opposite end. The outside of the bat beyond the handle is polished and it has an interior cavity. Reinforcing is providing in the cavity to increase resistance of the bat to bending upon impact. The reinforcing and bat body proper combine to attribute swing weight and feel to the bat which approximates that of a conventional flared bat.

31 Claims, 2 Drawing Figures

BASEBALL TRAINING BAT

This is a continuation of co-pending application Ser. No. 554,027 filed on Jan. 23, 1984 (abandoned), which application is a continuation of application Ser. No. 323,726 filed Nov. 23, 1981 (abandoned) and application Ser. No. 121,999 filed Feb. 19, 1980 (abandoned).

FIELD OF THE INVENTION

The present invention relates to a practice bat for use in developing the skill and strength employed in hitting a baseball.

BACKGROUND PRIOR ART

The present invention is a bat particularly adapted for use as a practice bat. The bat of the invention is intended for use in practice to develop batting strength, bat speed and hand-eye coordination. In order to accomplish these objectives, as will be described, one of the features of the invention is that the practice bat is somewhat heavier than a conventional baseball bat of equal length and it includes a shaft portion which is substantially thinner than that of a conventional bat.

For reference to prior art bats other than coventional baseball bats attention is directed to the Niederberger U.S. Pat. No. 3,179,412, issued Apr. 20, 1965 and the Anderson U.S. Pat. No. 2,964,321, issued Dec. 13, 1960.

SUMMARY OF THE INVENTION

The present invention provides a baseball practice or training bat particularly adapted to develop a batter's skill with respect to hitting a baseball and particularly for improving strength in the muscles used for batting, thereby improving bat control and bat speed, and also for improving hand-eye coordination.

The baseball practice bat of the invention includes a practice bat comprised of an elongated hollow tubular member having opposite ends and a central cavity, the hollow tubular member including a handle portion adapted to be gripped by a batter, the handle portion having a first uniform diameter along its length, and a shaft portion extending from the handle portion. The handle portion and the shaft portion have a continuous uniform diameter from the handle portion through the shaft portion.

One feature of the invention is a practice bat having a handle portion and a shaft portion comprised of an elongated constant diameter metal tube.

Another feature of the invention is a practice bat comprised of an elongated hollow tubular member having an elongated central cylindrical cavity and further including a foamed polymer material filling the central cavity.

Another feature of the invention is the provision of a practice bat having a weight to length ratio which is greater than 1.2 ounces per inch and wherein the weight to length ratio is substantially constant along the length of the bat.

One of the advantages of the practice bat embodied in the invention is that it develops the batter's concentration with respect to hitting the baseball. This is accomplished because the shaft of the bat has a diameter which is substantially narrower than that of a conventional bat, and consequently it is more difficult for the hitter to make contact with the ball. In a preferred embodiment of the invention, the shaft surface is polished such that it has a relatively low coefficient of friction. This increases the requirement that the batter strike the ball squarely, thereby further improving the effectiveness of the bat in improving the bat control and hand-eye coordination of the batter.

Another of the advantages of the practice bat of the invention stems from the weight of the bat as compared to a conventional baseball bat and the distribution of the weight of the bat along the length of the bat. A practice bat embodying the invention has a weight to length ratio which is at least as great as 1.2 ounces per inch and is accordingly heavier than a conventional baseball bat. However, the weight to length ratio is substantially constant along the length of the bat rather than being greater at the end of the bat away from the handle as in the conventional bat. Because of the balance of the bat embodying the invention, the extra weight of the bat does not hinder the batter's swing and he is free to take a natural freely moving swing with the correct amount of stress, the additional weight of the bat tending to develop the batter's strength and bat speed but not at the expense of a freely moving swing and bat control.

Other features and advantages of the invention will become apparent from the following description, the claims and the drawings.

Figure 1:
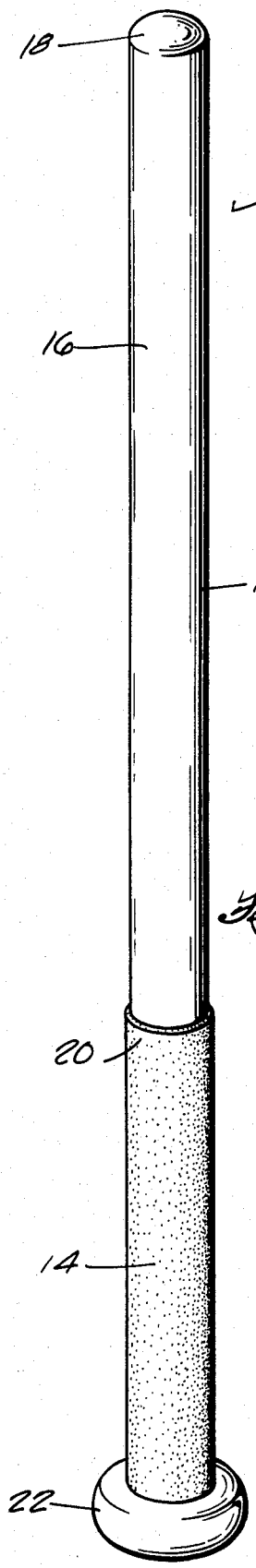
FIG. 1 is a perspective view of a practice bat embodying the present invention.
Figure 2:
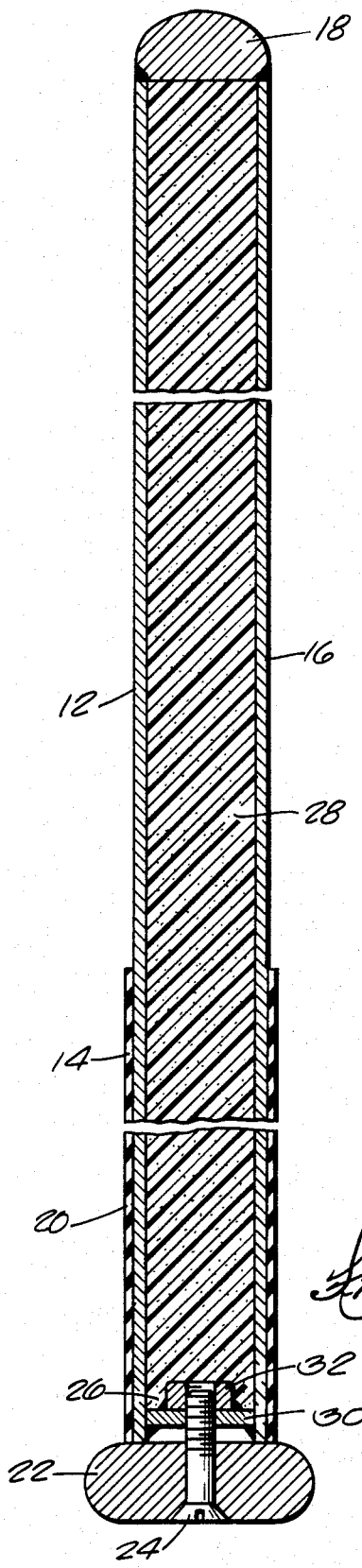
FIG. 2 is a cross section elevation view of the practice bat shown in FIG. 1.

Before describing the preferred embodiment of the invention in detail, it is to be understood that the invention is not limited in its application to the details of construction and the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF A PREFERRED EMBODIMENT

A baseball practice bat 10 embodying the present invention is illustrated in the drawing and is generally comprised of an elongated tubular member 12 including a handle portion 14 adapted to be gripped by a batter and a shaft portion 16 extending from the handle portion. In a preferred form of the invention, the elongated tubular member 12 is comprised of conventional iron pipe material commonly referred to as $\frac{3}{4}$ inch pipe. The extending end of the elongated tubular member 12 is closed by a rounded plug 18 welded thereto. The handle portion 14 of the elongated tubular member 12 is conveniently surrounded by a rubber or plastic grip 20 or tape to permit the batter to firmly grip the bat and to prevent the bat from slipping out of the batter's grasp. The bat 10 also includes a knob 22 attached to the end of the handle portion 14 of the bat by a screw 24 which is threadably received within a threaded bushing 26 welded to the interior portion of the handle end of the bat, the knob 22 functioning also to prevent the bat from slipping out of the grip of the batter.

As will be readily appreciated, it is important that the bat have a high impact resistance due to the impact of a baseball on the bat which would otherwise tend to cause bending of the bat. In a preferred form of the invention, the elongated tubular member 12 is completely filled with a foam material 28 in order to add strength to the iron pipe and to resist bending of the bat upon impact and over repeated use.

The foam material 28 within the tubular member also functions to provide an improved sound quality to the bat.

While various materials could be employed to fill the tubular member or to provide improved strength characteristics, in the illustrated construction a urethane material having a foamed density of approximately 16 pounds per cubic foot provides the desired weight and strength characteristics and has been found to be effective to increase the strength of the bat to thereby preclude bending of the bat. While the illustrated construction of the invention includes the use of a foam material housed in the tubular member of the bat, it will be readily appreciated by those skilled in the art that the use of the foam material within the bat could be eliminated if the required strength is otherwise achieved.

The practice bat embodying the invention can be used by a batter to actually hit a baseball propelled by a batting machine or thrown by a pitcher as well as to hit a baseball supported by a batting tee.

As described to this point, it will be noted that the handle and shaft portions, 14 and 16, have a uniform diameter; or viewed another way at no point along its length is the diameter of the shaft portion greater than that of the handle portion.

One of the features of the practice bat of the invention is that it develops hand-eye coordination since it has a narrow diameter shaft 16 and a polished surface, these qualities forcing the hitter to apply greater concentration and effort in order to make good contact with a baseball. For example, if a hitter takes his eye off the ball, due to the narrow diameter of the shaft, his chances of making good contact are slim. If the hitter hits the ball either above or below its center, the ball will readily glance off or foul off the slick surface of the bat shaft.

Another of the features of the practice bat embodying the invention is that it has a nearly uniform weight to length ratio along the length of the bat thereby providing a desireable balance. While the bat is intended to have a weight which is greater than that of a conventional bat whereby the batter can develop batting strength through the use of the bat, due to the weight distribution in the bat, i.e. the balance of the bat, the swing weight and feel of the bat approximates that of a conventional bat with a barrel end wherein the bat flares outwardly at an increasing diameter towards the end opposite to its handle. Thus the batter is able to develop a natural free swing with the bat without undue muscular stress, thereby building strength and bat control.

In one embodiment of the invention, the practice bat illustrated in the drawings can be constructed in a manner as set forth as follows. A black iron $\frac{3}{4}''$ pipe, i.e. having an inside diameter of approximately $\frac{3}{4}''$, and commonly referred to as "gas pipe" is cut to the desired length. A circular slug is then welded to one end of the length of the pipe and the external surface fo that slug is ground down to form a rounded closed end 18 on one end of the pipe. The pipe and the slug can then be chrome plated and polished to a suitable finish.

The pipe is then filled with a polyurethane foam material 28. In the preferred embodiment, the polyurethane foam material is a 16 pound per cubic foot foam of the type referred to as Polycell, manufactured by Coplanar Corporation, Oakland, Calif., 94608. The bat is filled with the polyurethane foam by first mixing the two components of the Polycell foam in equal parts employing a paint stirer for approximately 16 seconds. The mixture is then promptly poured into the shaft of the bat whereupon it will expand in approximately one minute so as to fill the bat and project out of the open end of the bat. The excess material projecting from the open end of the elongated tube is then cut off. Once the polyurethane foam material has cured, a $\frac{3}{4}$ inch washer 30 with a thickness of approximately $\frac{1}{8}$ inch is tack welded to a $\frac{1}{4}$ inch stove or machine nut 32 with the nut concentric with the washer. The washer and nut are placed in the open end of the pipe and the periphery of the washer 30 is welded to the inside of the pipe to thereby form the threaded bushing 26. Subsequently, a rubber tube 20 approximately 21 inches long and having a wall thickness of approximately 1/16 inch is stretched over the handle end of the elongated tube and the knob 22 is secured to the handle end of the elongated tube by the screw 24.

A baseball practice bat embodying the invention can be constructed in a variety of lengths but like conventional baseball bats they are preferably constructed in lengths ranging from 27" to 36". More particularly, the bats embodying the invention are constructed so as to have a weight to length ratio which is at least 1.2 ounces per inch and in a preferred form is in the range of 1.3 to 1.6 ounces per inch of length and wherein this weight to length ratio is constant over the entire length of the bat. As an example of a practice bat embodying the present invention and constructed in the manner described above, if the practice bat is constructed so as to be 27 inches in length it will have a weight of 39 ounces and will have a weight to length ratio of approximately 1.44 ounces per inch along the entire length of the bat. Similarly, if the bat is 29 inches in length it will have a weight of 41 ounces and a weight to length ratio of 1.41 ounces per inch. A similar 29 inch conventional baseball bat has a weight of 21 ounces and a weight to length ratio which varies from the handle to the shaft. A practice bat embodying the invention and being 31 inches in length will have a weight of 46 ounces and a weight to length ratio of 1.48 ounces per inch. A practice bat embodying the invention and being 32 inches in length will have a weight of 48 ounces and a weight to length ratio of 1.5 ounces per inch; a conventional baseball bat of the same length will have a weight of 31 ounces. A 34 inch practice bat constructed in the manner described above will have a weight of 51 ounces and a weight to length ratio of 1.5 ounces per inch. A 34 inch conventional baseball bat will have a weight of 33 ounces. A practice bat embodying the invention and being 36 inches in length will have a weight of 55 ounces and a weight to length ratio of 1.53 ounces per inch. From these examples it can be seen that while a conventional baseball bat has a weight to length ratio which is less than 1.0, a practice bat embodying the invention and constructed in the particular manner described above has a weight to length ratio of 1.4 to 1.6 ounces per inch.

Various features of the invention are set forth in the following Claims.

I claim:

1. A bat comprising an elongated hollow tubular member having opposite ends said elongated hollow tubular member being between 32 and 36 inches in length and between 48 and 55 ounces in weight, and, said hollow tubular member having a central cavity and including a handle portion adapted to be gripped by a batter and a shaft portion extending from said handle portion and providing a striking surface for a thrown ball, means within said central cavity for reinforcing said hollow tubular member against bending, the handle portion having a generally uniform diameter along its length, said shaft portion having a diameter along the length thereof which is substantially equal to that of the diameter of said handle portion, the weight to length ratio of said bat being substantially constant along the length of said bat, and the diameter of said shaft portion being substantially uniform along the length thereof so that the striking surface for said bat is of uniform diameter from the handle portion through the end of said shaft portion remote from said handle portion and so that said striking surface is smaller in diameter than that of a conventional bat having a flared striking surface.

2. A bat as set forth in claim 1 wherein said handle portion and said shaft portion are comprised of an elongated constant diameter metal tube.

3. A bat as set forth in claim 1 wherein said shaft portion includes a polished, low friction external surface.

4. A bat as set forth in claim 1 wherein said elongated hollow tubular member includes an elongated central cylindrical cavity, and further including a foamed polymer material filling said central cavity and reinforcing said hollow tubular member against bending.

5. A bat as set forth in claim 4 wherein said foamed polymer material comprises urethane foam having a density greater than eight pounds per cubic foot.

6. A bat as set forth in claim 1 wherein said handle portion and said shaft portion comprise a continuous elongated metal tube having a constant outside diameter along its length from one end of the tube to an opposite end and an elongated central chamber extending from one end of said tube to the opposite end of said tube, and a foam polymer material filling said chamber.

7. A bat as set forth in claim 6 wherein said elongated metal tube includes an elongated cylindrical outer surface, said outer surface being polished at least along said shaft portion.

8. A bat as set forth in claim 1 wherein said central cavity extends from one end of said hollow tubular member to an opposite end of said hollow tubular member and wherein said central cavity is filled with urethane foam having a density of approximately 16 pounds per cubic foot.

9. A bat as set forth in claim 1 wherein said practice bat has a weight to length ratio which is greater than 1.2 ounces per inch.

10. A bat comprising an elongated hollow tubular member having opposite ends, said bat being between 27 and 31 inches in length and between 39 and 46 ounces in weight, and said hollow tubular member having a central cavity and including a handle portion adapted to be gripped by a batter and a shaft portion extending from said handle portion and providing a striking surface for a thrown ball, means within said central cavity for reinforcing said hollow tubular member against bending, the handle portion having a generally uniform diameter along its length, said shaft portion having a diameter along the length thereof which is substantially equal to that of the diameter of said handle portion, the weight to length ratio of said bat being substantially constant along the length of said bat, and the diameter of said shaft portion being substantially uniform along the length thereof so that the striking surface for said bat is of uniform diameter from the handle portion through the end of said shaft portion remote from said handle portion and so that said striking surface is smaller in diameter than that of a conventional bat having a flared striking surface.

11. A bat as set forth in claim 10 wherein said handle portion and said shaft portion are comprised of an elongated constant diameter metal tube.

12. A bat as set forth in claim 10 wherein said shaft portion includes a polished, low friction external surface.

13. A bat as set forth in claim 10 wherein said elongated hollow tubular member includes an elongated central cylindrical cavity, and further including a foamed polymer material filling said central cavity and reinforcing said hollow tubular member against bending.

14. A bat as set forth in claim 13 wherein said foamed polymer material comprises urethane foam having a density greater than eight pounds per cubic foot.

15. A bat as set forth in claim 10 wherein said handle portion and said shaft portion comprise a continuous elongated metal tube having a constant outside diameter along its length from one end of the tube to an opposite end and an elongated central chamber extending from one end of said tube to the opposite end of said tube, and a foam polymer material filling said chamber.

16. A bat as set forth in claim 15 wherein said elongated metal tube includes an elongated cylindrical outer surface, said outer surface being polished at least along said shaft portion.

17. A bat as set forth in claim 10 wherein said elongated hollow tubular member is between 32 and 36 inches in length and between 48 and 55 ounces in weight.

18. A bat as set forth in claim 10 wherein said central cavity extends from one end of said hollow tubular member to an opposite end of said hollow tubular member and wherein said central cavity is filled with urethane foam having a density of approximately 16 pounds per cubic foot.

19. A bat as set forth in claim 10 wherein said bat has a weight to length ratio of approximately 1.4 to 1.6 ounces per inch along the length of said bat.

20. A bat as set forth in claim 10 wherein said bat has a weight to length ratio which is greater than 1.2 ounces per inch.

21. A bat comprising an elongated hollow tubular member having opposite ends, said bat having a weight to length ratio of approximately 1.4 to 1.6 ounces per inch along the length of said bat, and said hollow tubular member having a central cavity and including a handle portion adapted to be gripped by a batter and a shaft portion extending from said handle portion and providing a striking surface for a thrown ball, means within said central cavity for reinforcing said hollow tubular member against bending, the handle portion having a generally uniform diameter along its length, said shaft portion having a diameter along the length thereof which is substantially equal to that of the diameter of said handle portion, the weight to length ratio of said bat being substantially constant along the length of said bat, and the diameter of said shaft portion being substantially uniform along the length thereof so that the striking surface for said bat is of uniform diameter from the handle portion through the end of said shaft portion remote from said handle portion and so that said striking surface is smaller in diameter than that of a conventional bat having a flared striking surface.

22. A bat as set forth in claim 21 wherein said handle portion and said shaft portion are comprised of an elongated constant diameter metal tube.

23. A bat as set forth in claim 21 wherein said shaft portion includes a polished, low friction external surface.

24. A bat as set forth in claim 21 wherein said elongated hollow tubular member includes an elongated central cylindrical cavity, and further including a foamed polymer material filling said central cavity and reinforcing said hollow tubular member against bending.

25. A bat as set forth in claim 24 wherein said foamed polymer material comprises urethane foam having a density greater than eight pounds per cubic foot.

26. A bat as set forth in claim 21 wherein said handle portion and said shaft portion comprise a continuous elongated metal tube having a constant outside diameter along its length from one end of the tube to an opposite end and an elongated central chamber extending from one end of said tube to the opposite end of said tube, and a foam polymer material filling said chamber.

27. A bat as set forth in claim 26 wherein said elongated metal tube includes an elongated cylindrical outer surface, said outer surface being polished at least along said shaft portion.

28. A bat as set forth in claim 21 wherein said elongated hollow tubular member is between 32 and 36 inches in length and between 48 and 55 ounces in weight.

29. A bat as set forth in claim 28 wherein said bat is between 27 and 31 inches in length and between 39 and 46 ounces in weight.

30. A bat as set forth in claim 21 wherein said central cavity extends from one end of said hollow tubular member to an opposite end of said hollow tubular member and wherein said central cavity is filled with urethane foam having a density of approximately 16 pounds per cubic foot.

31. A bat as set forth in claim 21 wherein said bat has a weight to length ratio which is greater than 1.2 ounces per inch.

* * * * *